US008950887B2

(12) United States Patent
Law et al.

(10) Patent No.: US 8,950,887 B2
(45) Date of Patent: Feb. 10, 2015

(54) LED LIGHT STRIP WITH DETACHABLE LED FLASHLIGHTS ASSEMBLY

(71) Applicants: Calvin Chuen Kam Law, Chino, CA (US); George Lee, Brea, CA (US)

(72) Inventors: Calvin Chuen Kam Law, Chino, CA (US); George Lee, Brea, CA (US)

( * ) Notice: Subject to any disclaimer, the term of this patent is extended or adjusted under 35 U.S.C. 154(b) by 89 days.

(21) Appl. No.: 13/757,801

(22) Filed: Feb. 3, 2013

(65) Prior Publication Data

US 2014/0218899 A1 Aug. 7, 2014

(51) Int. Cl.
*F21L 4/00* (2006.01)
*F21L 4/04* (2006.01)

(52) U.S. Cl.
CPC ..... *F21L 4/04* (2013.01)
USPC ..... 362/183; 362/249.02; 362/640

(58) Field of Classification Search
USPC ..... 362/183, 640–646, 249.02, 800, 249.11
See application file for complete search history.

(56) References Cited

U.S. PATENT DOCUMENTS

2011/0013385 A1* 1/2011 Chien ..... 362/183

* cited by examiner

*Primary Examiner* — Anne Hines
(74) *Attorney, Agent, or Firm* — Alexander Chen, Esq.

(57) ABSTRACT

A modular lighting system for mounting in the garage, under a cabinet, or on a wall area includes a LED light mounted in the housing and two battery operated detachable, removable flashlight assemblies mounted in the housing. The flashlight assembly includes a rechargeable battery; an electrical device, such as a male plug for interconnecting the battery and power source; and an electrical device for sensing power loss. The lighting system also includes a flashlight electrical connection in the housing, such as a plug receptacle, for connection to the male plug for supplying power from the power source to the detachable flashlight assembly.

24 Claims, 5 Drawing Sheets

LED LIGHT STRIP WITH DETACHABLE LED FLASHLIGHTS ASSEMBLY

FIELD OF THE INVENTION

The present invention relates to a wall-mounted or an under cabinet/counter lighting system used as a standard lighting source for a room or an emergency lighting source and, more particularly, this lighting system includes three components being two detachable, removable flashlight assemblies and a light fixture in which the flashlight assemblies can be attached, stored, and recharged.

BACKGROUND OF THE INVENTION

Several types of multi-functional lamp fixtures, which are typically mounted on walls or ceilings, have been utilized in the past in homes, offices, or industrial plant facilities. These multi-functional lamps can be used for normal operational functions; or for emergency situations involving power failures, where interior or exterior areas have no light. Such multi-functional lighting fixtures have various combinations that include: a fluorescent lamp and a spotlight; a rechargeable flashlight and a night light; a fluorescent lamp, a spotlight and an emergency strobe light; and a flashlight, a fluorescent lamp, an emergency hazard warning light, and various other combinations. These multi-functional lamp fixtures have the ability to be stationary, portable, or both stationary and portable, where the input power for the stationary fixture component is from an AC adaptor or AC receptacle; and the input power for the portable fixture component is from a DC adaptor or batteries.

Multi-functional lamp fixtures of various designs, styles and materials of construction have been disclosed in the prior art. For example, U.S. Pat. No. 4,590,543 discloses a trilight being a fixed or portable lighting device, wherein a single light bulb acts as a night light, an emergency light, and a spotlight. The trilight is normally attached to a wall having an AC adaptor for charging the batteries. A pivotal light head can be adjusted to four angles 0 degree., 30 degrees, 60 degrees, and 90 degrees to facilitate illumination. This patent does not disclose a portable lighting device having three different light fixtures.

U.S. Pat. No. 4,977,489 discloses a portable battery-operated lighting device having a flashlight section on one end, a fluorescent light section on the other end, and a hazard warning light section. This lighting device has a U-shaped configuration, with the fluorescent and warning light sections being pivotal at a 90.degree. angle downwardly. This patent does not disclose a portable lighting device having a detachable flashlight and a night light.

U.S. Pat. No. 4,782,432 discloses a multi-function portable lighting device having a spotlight section, a fluorescent light section, and a strobe light section being housed in an elongated cylindrical transparent housing. This patent does not disclose a portable lighting device having a detachable flashlight and a night light.

There remains a need for an under cabinet lighting fixture which is capable of providing both normal and emergency lighting needs, where the fixture has both stationary and portable components being two detachable, removable flashlights and a light fixture contained within a singular housing element. The present invention provides for a light bar that accomplishes the above and also provides additional, improved functionality.

OBJECT OF THE INVENTION

Accordingly, it is an object of this invention to provide a method and system for a lighting system having detachable flashlight components on the ends of the housing and a light in the middle section.

It is also an object of the present invention is to provide for an emergency light source which is battery operated and rechargeable and is detachable from one end of the main housing of an lighting fixture.

It is also an object of this invention to provide a lighting system for mounting in the garage, under a cabinet, or on a wall area for use at home, in a office, or at a work facility.

It is also an object of this invention to provide a lighting system having light-emitting-diodes (LEDs) as its illuminating source to illuminate the main housing as well as the flashlight assemblies.

It is also an object of this invention to provide a lighting system having flashlight assembly that includes a rechargeable battery and/or a standard disposable battery.

It is also an object of this invention to provide a lighting system having flashlight assembly that includes an electrical device, such as a male plug for interconnecting the battery and power source.

It is also an object of this invention to provide a lighting system having flashlight assembly that includes an electrical device for sensing power loss.

It is also an object of this invention to provide a lighting system that includes an electrical connection in the housing, such as a plug receptacle, for connecting the housing to the flashlight assembly to supply power from the power source to the detachable flashlight assembly.

It is also an object of this invention to provide a lighting system that includes an electrical connection in the housing that allows a connector to connect to a standard household outlet at 120 volts or 240 volts.

It is also an object of this invention to provide a lighting system comprising a main housing lighting unit and at least one detachable flashlight assembly that can be electrically powered by both rechargeable batteries as well as standard disposable batteries.

It is also an object of this invention to provide a lighting system that can be mass produced in an automated and economical manner and is readily affordable by the consumer.

It is also an object of this invention to provide a lighting system that is simply and easy to install and does not require extensive, if any, modification to the surface area to which the lighting system is mounted.

It is also an object of this invention to provide lighting system that will not distract from the aesthetics of the surface area to which the lighting system is mounted, and, in face, the lighting system will improve the aesthetics.

It is also an object of this invention to provide a lighting system that can be electrically connected to a standard electrical outlet from which to draw electricity to power and recharge the lighting system.

It is also an object of this invention to provide a lighting system having the function of reacting to sound, such as clapping to turn the lighting system on as well as to turn the lighting system off.

It is also an object of this invention to provide a lighting system with a sensor having the function of automatically lighting up when its surrounding is dark and for turning off when its surrounding is bright.

It is also an object of this invention to provide a lighting system having the function of being water proof sealed.

SUMMARY OF THE INVENTION

Presently disclosed is a lighting apparatus suitable for mounting to an underside of a cabinet having a primary unit and at least one detachable unit wherein the primary unit and aid detachable unit are comprised of at least one light unit for illumination wherein the detachable unit is attached to the primary unit and is detachable from the primary unit to function as a handheld flash light unit wherein the detachable light unit is further comprised of at least one battery unit to hold electrical charge to power the detachable unit when the detachable unit is detached from the primary unit. In one embodiment, the primary unit charges the detachable unit's battery when the detachable unit is attached to say primary unit. In one embodiment, light unit of the detachable unit draws electric power from the battery of the detachable unit when the detachable unit is attached to the primary unit.

In one embodiment, the light unit is a LED light. In one embodiment, the primary unit draws electrical power from a housing unit which the cabinet is installed in. In one embodiment, the primary unit is further comprised of a electrical charger is capable of charging the battery of the detachable unit when the detachable unit is attached to the primary unit. In one embodiment, detachable unit is further comprised of a handle suitable for hand holding when detached from the primary unit. In one embodiment, the detachable unit is further comprised of more than one light unit in at least two of the surfaces of the detachable unit. In one embodiment, the lighting apparatus draws electrical power from a 120 v power outlet. In one embodiment, the lighting apparatus draws electrical power from a 240 v power outlet. In one embodiment, the lighting apparatus respond to a sound command. In one embodiment, the lighting apparatus further comprise a light activated night light. In one embodiment, the lighting apparatus further comprise a motion activated night light.

Disclosed is another aspect of the invention which is a method to provide lighting to an interior space comprising a lighting apparatus suitable for mounting to an underside of a cabinet having a primary unit and at least one detachable unit wherein the primary unit and aid detachable unit are comprised of at least one light unit for illumination wherein the detachable unit is attached to the primary unit and is detachable from the primary unit to function as a handheld flash light unit wherein the detachable light unit is further comprised of at least one battery unit to hold electrical charge to power the detachable unit when the detachable unit is detached from the primary unit.

In another embodiment, the primary unit charges the detachable unit's battery when the detachable unit is attached to say primary unit. In another embodiment, the light unit of the detachable unit draws electric power from the battery of the detachable unit when the detachable unit is attached to the primary unit. In another embodiment, wherein the light unit is a LED light. In another embodiment, the primary unit draws electrical power from a housing unit which the cabinet is installed in. In another embodiment, the primary unit is further comprised of a electrical charger is capable of charging the battery of the detachable unit when the detachable unit is attached to the primary unit. In another embodiment, the detachable unit is further comprised of a handle suitable for hand holding when detached from the primary unit. In another embodiment, the detachable unit is further comprised of more than one light unit in at least two of the surfaces of the detachable unit. In another embodiment, wherein the lighting apparatus draws electrical power from a 120 v power outlet. In another embodiment, wherein the lighting apparatus draws electrical power from a 240 v power outlet. In another embodiment, the lighting apparatus respond to a sound command. In another embodiment, the lighting apparatus further comprise a light activated night light. In another embodiment, the lighting apparatus further comprise a motion activated night light.

BRIEF DESCRIPTIONS OF THE DRAWINGS

These and other features and advantages of the invention will not be described with reference to the drawings of certain preferred embodiments, which are intended to illustrate and not to limit the invention, and in which.

DETAIL DESCRIPTIONS OF THE INVENTION

Figure 1:
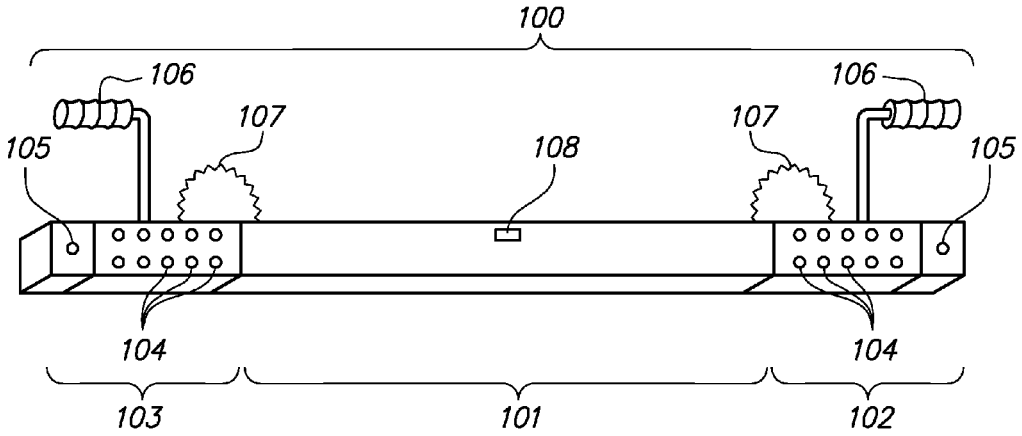
FIG. 1 is a schematic drawing illustration of an embodiment of the lighting system comprised of a light fixture and two detachable flashlight assemblies each attached to the ends of the light fixture.

In accordance with the present invention disclosed herein, an improved and easy to install modular lighting system for mounting in the garage, under a cabinet, or on a wall area.

The lighting system includes a light fixture with a lighting source and a housing unit wherein the lighting source is enclosed, as well as at least one detachable flashlight assembly. The lighting source can be a standard fluorescence light, incandescent light, or, preferably, light-emitting-diodes (LED). The use of LEDs to provide illumination is desirable because LEDs lights up with a faster response time than traditional bulbs. Also, LEDs are small and completely solid state; as such, they have no mechanical parts that may fail or require maintenance. Moreover, LEDs are very power-efficient, which is ideal because of increasing energy costs. Finally, LEDs have very long lives because they have no filaments that can burn out, as such LEDs require minimum, if any, maintenance and they do not need to be changed as often as traditional illumination source.

The lighting system can be mounted on walls or ceilings, under cabinets, or any other place requiring illumination. These lighting systems can be used in homes, offices, or industrial plant facilities. They can serve as standard lighting systems for everyday use, or they can serve as emergency lighting.

The lighting system is, in one part, comprised of a light fixture with a lighting source, preferably LED as mentioned above, and a housing in which to enclose the lighting source. The light fixture is then mounted to a surface as described above to provide the necessary illumination.

The lighting system is further comprised of two battery operated detachable, removable flashlight assemblies mounted in the housing as described above. The flashlight assembly includes a battery; an electrical device, such as a male plug for interconnecting the battery and power source; and an electrical device for sensing power loss. The batteries in the flashlight assembly can be rechargeable batteries, in which they can be recharged via reattaching or mounting the flashlight assembly back onto the light fixture. The batteries in the flashlight assembly can also be standard disposable batteries such as double A or triple A batteries, in which they can simply be replaced with fresh over-the-counter batteries when the old ones are depleted.

The lighting system also includes a flashlight electrical connection in the housing, such as a plug receptacle, for connection to the male plug for supplying power from the power source to the detachable flashlight assembly. Furthermore, the housing includes a connector for connecting to a standard household outlet and can draw power from both 120 volts or 240 volts outlets.

The flashlight assembly also includes an electrical device, such as a male plug for interconnecting the battery and power source. As mentioned above, the flashlight assembly can be recharged by drawing power from the power source of the light fixture itself. As such, a method of connecting the power source of the flashlight and that of the light fixture is required. The male plug in the flashlight connecting to the plug receptacle in the housing allows the batteries in the flashlight to be recharged by the power source in the light fixture.

Furthermore, the flashlight assembly can include an electrical device sensing power loss. As the flashlight assembly is detached and removed from the light fixture for portable use, the batteries in the flashlight assembly will be depleted over time as the lighting source draws power from the batteries. Therefore, an electrical device sensing power loss will be useful in determining the residual power in the batteries as the flashlight is being used. This will alert the user as to the status of the power in the batteries of the flashlight, thus notifying the user to reattach and mounted the flashlight assembly back to the light fixture to allow the batteries in the flashlight assembly to be recharged via the power source of the light fixture.

The lighting system further includes the function have reacting to sounds. The lighting system can react to sounds such as a clap, thereby either turning the light on or off. Moreover, the lighting system includes a sensor for sending the illumination of its surroundings. The lighting system automatically turns on when the sensor detects that its surroundings are dark, and the lighting system automatically turns off when the sensor detects that its surroundings are illuminated.

DETAIL DESCRIPTIONS OF THE DRAWINGS

Referring to the drawings which illustrate preferred forms of the present invention, FIG. 1 illustrates the embodiment of an overall scheme of an LED lighting system 100 according to the disclosed invention. More specifically, the LED light fixture 101 attaches to a wall, ceiling, or underneath a cabinet, wherein the LED light fixture 101 illuminates the room or cabinet as necessary. The lighting system 100 is comprised of a light fixture 101, a right, detachable flashlight 102, and a left, detachable flashlight 103. Both flashlights 102, 103 have LEDs 103 as its illuminating source, has a on/off switch 105 to turn the flashlight on or off, and a handle 106 for hand holding the flashlight device 102, 103. Furthermore, in one embodiment, the flashlights 102, 103 are secured with a flexible cord or rubber 107 to the light fixture 101. Finally, the light fixture 101 also has a sensor 108 for detecting the level of illumination of its surroundings in order to automatically adjust its illumination accordingly.

Figure 2:
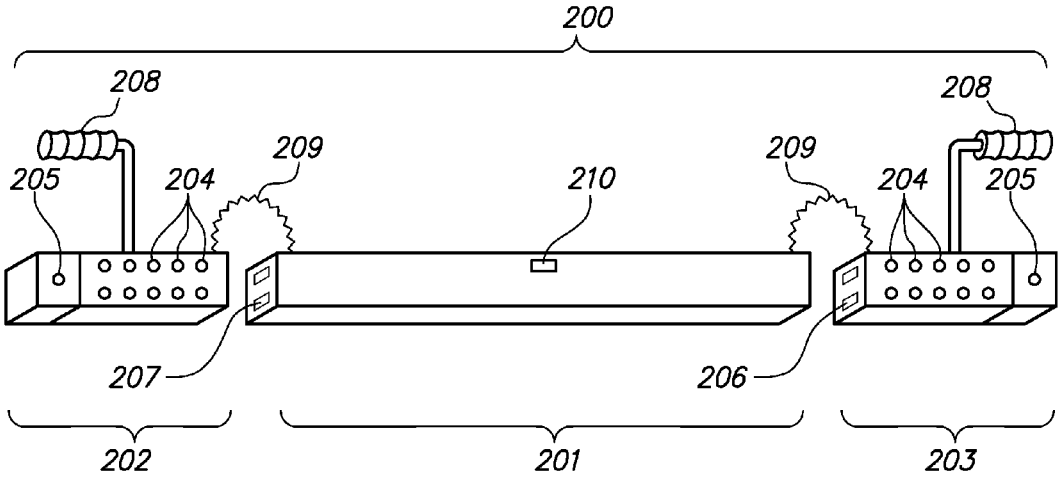
FIG. 2 is a schematic drawing illustration of an embodiment of the lighting system comprised of a light fixture and two detachable flashlight assemblies each separated from the ends of the light fixture.

FIG. 2 illustrates an embodiment of the lighting system 200 comprising a light fixture 201 for attaching to a wall, ceiling, or underneath a cabinet, a left, detachable flashlight 202, and a right, detachable flashlight 203. Both flashlights 202, 203 have LEDs 204 as its illuminating source and has a on/off switch 205 to turn the flashlight on or off. Furthermore, both flashlights 202, 203 have a male plug 206 for connecting to the light fixture 201, which also has a corresponding receptor 207. This plug 206 and receptor 207 allow for the flashlights 202, 203 to be powered and/or recharge their batteries via drawing electricity from the light fixture 201. The flashlights 202, 203 has handle 208 for holding the flashlight units. Furthermore, the flashlights 202, 203 can be secured with a flexible cord or rubber 209. In another embodiment, the flexible cord or rubber 209 are not included. Finally, the light fixture 201 also has a sensor 210 for detecting the level of illumination of its surroundings in order to automatically adjust its illumination accordingly.

Figure 3:
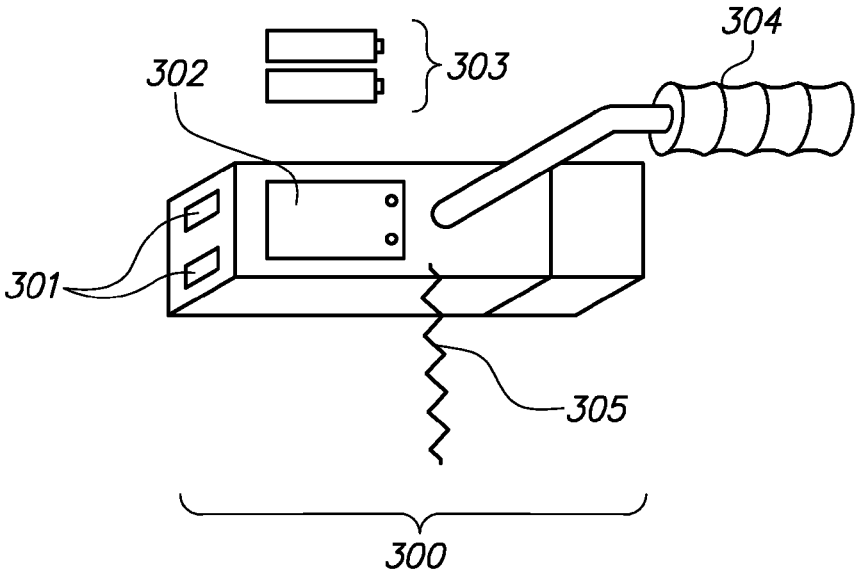
FIG. 3 is a schematic drawing illustration of an embodiment of the back of the flashlight assembly.

FIG. 3 illustrates an embodiment of just the individual flashlight 300 of the lighting system as separated rest of the lighting system. More specifically, this is the back view of the flashlight 300 with its male plug 301 showing. As described above, the male plug 301 is used to connect to the light fixture. The back of the flashlight 300 is comprised of a securing mechanism as well as handle 304, and an area 302 for installing the batteries 303. The batteries 303 can be rechargeable batteries to be recharged by the light fixture when attached or the batteries 303 can be standard, disposable batteries such as AA or AAA, etc. The flashlight 300 further includes a hook 304 for securing them to the light fixture or other areas, and a flexible, cord or rubber 305 for connecting the flashlight 300 to the light fixture.

Figure 4:
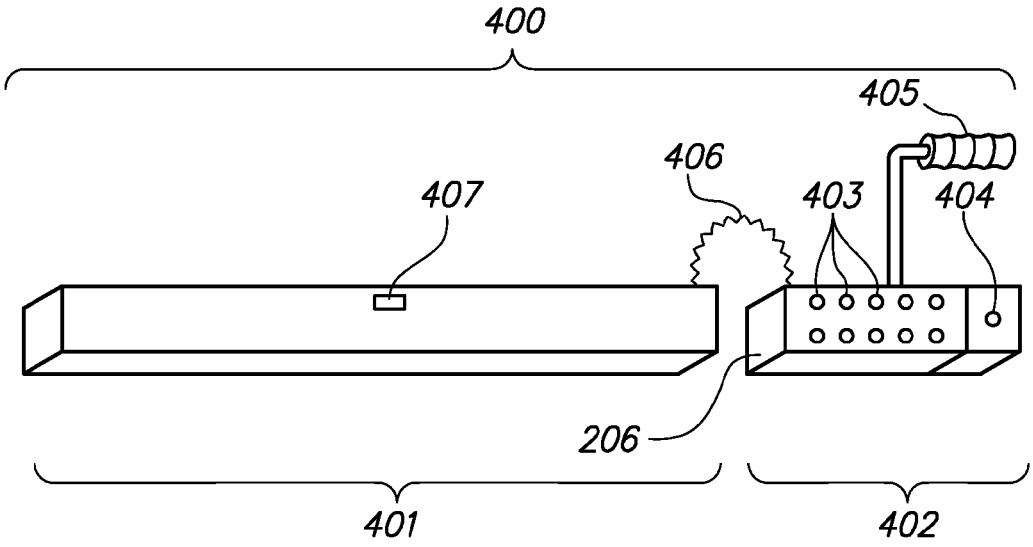
FIG. 4 is a schematic drawing illustration of an embodiment of the lighting system with one detachable flashlight attached to one end of the light fixture.

FIG. 4 illustrates an embodiment of the LED lighting system 400 comprised of a light bar 401 and a detachable flashlight 402 attached to the light bar 401 according to the disclosed invention. More specifically, the LED light bar 401 and the flashlight 402 can be separated from each other to be used separately and simultaneously, or they can be attached to each other. On the flashlight 402, there is a button for controlling the illumination of the flashlight 402 or for turning the flashlight 402 on or off. Furthermore, the flashlight 402 has two sets of LED lights—one set of LED lights 403 in the body of flashlight and another set of LED lights 404 at the end of the flashlight for providing illumination. The flashlight 402 includes both a handles 405 for holding the flashlight 402 is detached from the light fixture 401, and a flexible, cord or rubber 406 for connecting the flashlight 402 to the light fixture 401. Finally, the light fixture 401 also has a sensor 407 for detecting the level of illumination of its surroundings in order to automatically adjust its illumination accordingly.

Figure 5:
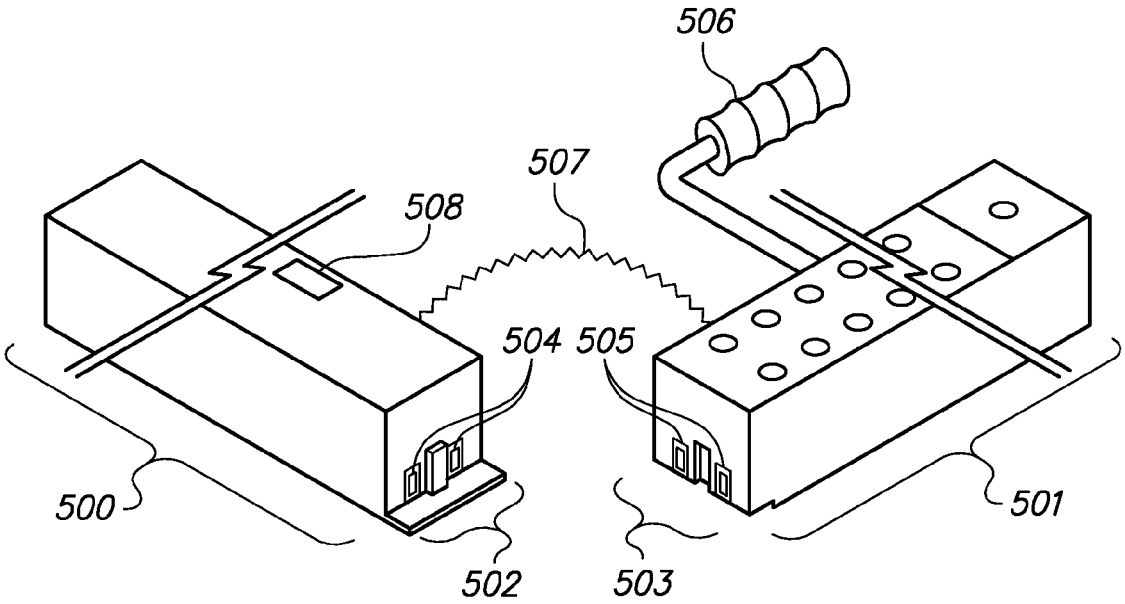
FIG. 5 is a schematic close-up drawing illustration an embodiment of the lighting system that is comprised of a light fixture with one detachable flashlight detached from the end of the light fixture.

FIG. 5 illustrates an embodiment of the LED lighting system with the light bar 500 and the flashlight 501 detached from each other. Where the light bar 500 and the flashlight 501 attach and connect to each other, there are a securing mechanism 502, 503 and a charging mechanism 504, 505. The securing mechanism 502, 503 allows the flashlight 501 to be reattached to the light bar 500 securely and easily, while still allow the flashlight 501 to be easily detached from the light bar 500 when necessary. The charging mechanism is comprised of metal connectors 504, 505 on the end of the light bar 500 and on the end of the flashlight 501, wherein by connecting the flashlight 501 to the light bar 500 will allow the batteries in flashlight 501 to be charged through the light bar 500 via electricity drawn from the automobile. The flashlight 501 includes both a handle 506, and a flexible, cord or rubber 507 for connecting the flashlight 501 to the light fixture 500. Finally, the light fixture 500 also has a sensor 508 for detecting the level of illumination of its surroundings in order to automatically adjust its illumination accordingly.

Figure 6:
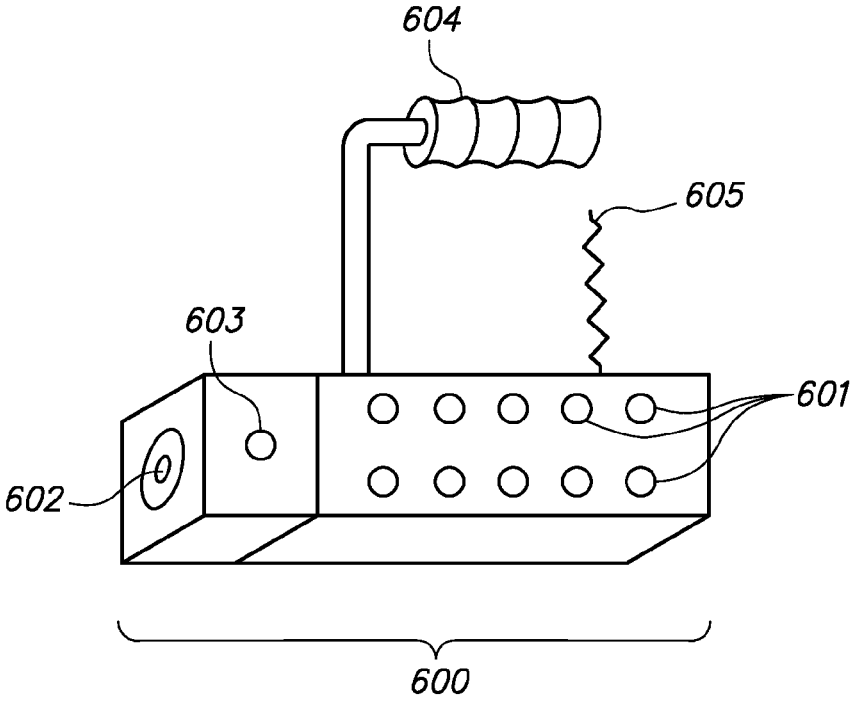
FIG. 6 is a schematic drawing illustration of an embodiment of the flashlight as detached from the lighting fixture.

FIG. 6 illustrates an embodiment of the LED flash light 600 only, as detached from the light bar of the lighting system. The LED flashlight 600 has two sets of LEDs—one set of LEDs in the body 601 of the flashlight 600 itself and another set of LEDs at the end 602. The LEDs in the body 601 of the flashlight provides a wider coverage of illumination, whereas the LEDs in the end 602 of the flashlight provides a more focused coverage of illumination. The button 603 on the flashlight serves to control the sets of LEDs 601, 602 for illumination, the intensity or type of illumination, and/or powering on or off the flash light. Furthermore, there is also a handling mechanism 604 to hold the flashlight unit 600.

Figure 7:
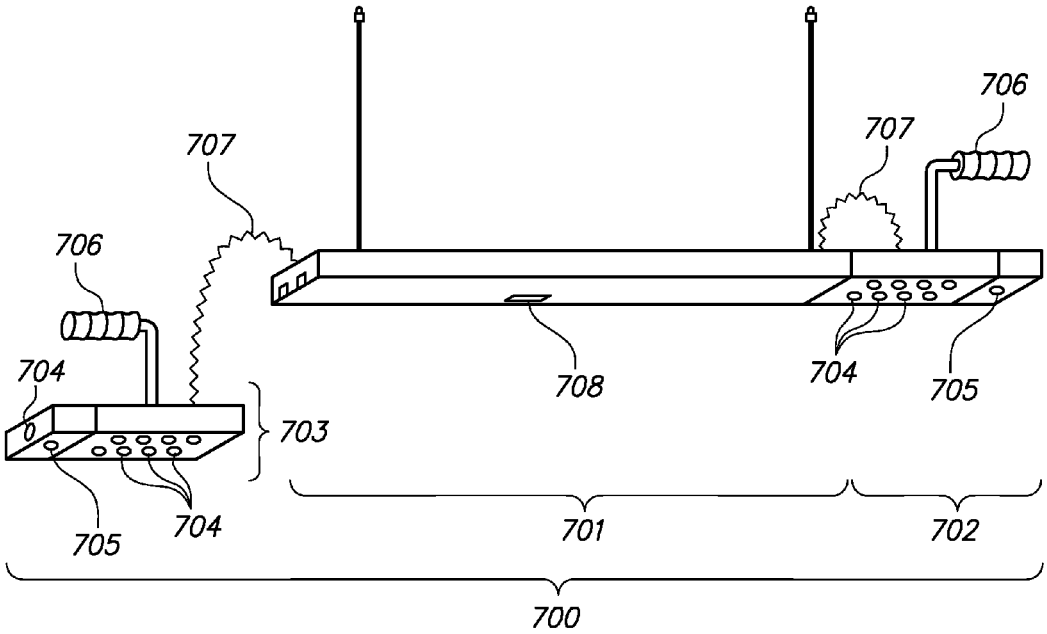
FIG. 7 is a schematic drawing illustration of an embodiment of the lighting system hanging on the wall with one flashlight detached from the lighting fixture.

FIG. 7 illustrates another embodiment of an overall scheme of an LED lighting system 700 according to the disclosed invention. More specifically, the LED light fixture 701 is attached to the ceiling, wherein the LED lighting system 700 illuminates the room or as necessary. The lighting system 700 is comprised of a light fixture 701, a right, detachable flashlight 702, and a left, detachable flashlight 703. Both flashlights 702, 703 have LEDs 704 as its illuminating source, has a on/off switch 705 to turn the flashlight on or off, and a handle 706 for handling the flashlights 702, 703 as necessary. Furthermore, the flashlights 702, 703 are secured with a flexible cord or rubber 707 to the light fixture 701. Finally, the light fixture 701 also has a sensor 708 for detecting the level of illumination of its surroundings in order to automatically adjust its illumination accordingly.

Figure 8:
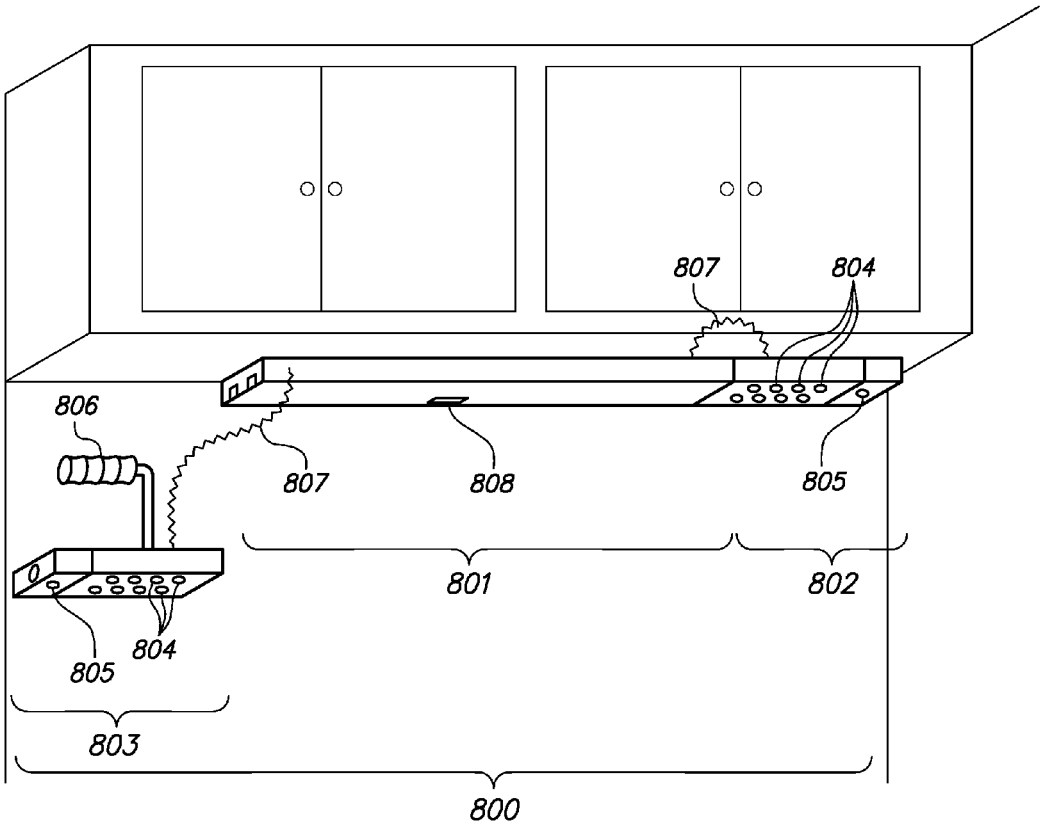
FIG. 8 is a schematic drawing illustration of an embodiment of the lighting system installed underneath a cabinet with one flashlight detached from the lighting fixture.

FIG. 8 illustrates the embodiment of an overall scheme of an LED lighting system 800 according to the disclosed invention. More specifically, the LED light fixture 801 is attached underneath a cabinet, wherein the LED lighting system 800 illuminates the room or as necessary. The lighting system 800 is comprised of a light fixture 801, a right, detachable flashlight 802, and a left, detachable flashlight 803. Both flashlights 802, 803 have LEDs 804 as its illuminating source, has a on/off switch 805 to turn the flashlight on or off, and a handle 806. Furthermore, the flashlights 802, 803 are secured with a flexible cord or rubber 807 to the light fixture 801. Finally, the light fixture 801 also has a sensor 808 for detecting the level of illumination of its surroundings in order to automatically adjust its illumination accordingly.

The invention claimed is:

1. A lighting apparatus suitable for mounting to an underside of a cabinet having a primary unit and at least one detachable elongate unit wherein said primary unit and said detachable elongate unit are comprised of at least one light unit for illumination wherein said detachable elongate unit is attached to said primary unit on its one end and is detachable from said primary unit to function as a handheld flash light unit wherein said detachable elongate unit is further comprised of at least one battery unit to hold electrical charge to power said light unit when said detachable elongate unit is detached from said primary unit;

wherein said detachable elongate unit further comprises at least one handle for hand holding when it is detached from said primary unit;

wherein said handle is attached to and foldable onto one longitudinal side of said detachable elongate unit;

wherein said handle has a L shape and made from a round rod, and its lever is optionally implanted in a wooden end that has a larger diameter;

wherein said handle is perpendicular to and protruding from said longitudinal side when the detachable elongate unit is detached and in use;

wherein said detachable elongate unit further comprises at least one male plug placed on one end of said detachable elongate unit;

wherein said primary unit further comprises at least one female receptor to receive said male plug;

wherein, in addition to said plug, said detachable elongate unit further comprises a secure mechanism in the vicinity of said plug to further secure said detachable unit to said primary unit when said detachable unit is plugged in;

wherein said secure mechanism comprises two tabs perpendicular to each other, making an upside down T shape, protruding from one end of said primary unit, and two recesses fitting the shapes and sizes of said two tabs on one end of said detachable elongate unit to receive said two tabs snugly;

wherein said primary unit further comprises a flexible cord, whose one end is attached to said primary unit, and the other end is attached to said detachable elongate unit, to further secure said detachable elongate unit to said primary unit.

2. The apparatus of claim 1 wherein said primary unit charges said detachable unit's battery when said detachable unit is attached to said primary unit.

3. The apparatus of claim 1 wherein said light unit of said detachable unit draws electric power from said battery of said detachable unit when said detachable unit is attached to said primary unit.

4. The apparatus of claim 1 wherein said light unit is a LED light.

5. The apparatus of claim 1 wherein said primary unit draws electrical power from a housing unit which said cabinet is installed in.

6. The apparatus of claim 1 wherein said primary unit is further comprised of a electrical charger is capable of charging said battery of said detachable unit when said detachable unit is attached to said primary unit.

7. The apparatus of claim 1 wherein said detachable unit is further comprised of more than one light unit in at least two of the surfaces of said detachable unit.

8. The apparatus of claim 1 wherein said lighting apparatus draws electrical power from a 120 v power outlet.

9. The apparatus of claim 1 wherein said lighting apparatus draws electrical power from a 240 v power outlet.

10. The apparatus of claim 1 wherein said lighting apparatus respond to a sound command.

11. The apparatus of claim 1 wherein said lighting apparatus further comprise a light activated night light.

12. The apparatus of claim 1 wherein said lighting apparatus further comprise a motion activated night light.

13. A method to provide lighting to an interior space comprising a lighting apparatus suitable for mounting to an underside of a cabinet having a primary unit and at least one detachable unit wherein said primary unit and aid detachable unit are comprised of at least one light unit for illumination wherein said detachable unit is attached to said primary unit and is detachable from said primary unit to function as a handheld flash light unit wherein said detachable light unit is further comprised of at least one battery unit to hold electrical charge to power said detachable unit when said detachable unit is detached from said primary unit;

wherein said detachable elongate light unit is further comprised of at least one battery unit to hold electrical charge to power said detachable elongate unit when said detachable elongate unit is detached from said primary unit;

wherein said detachable elongate unit further comprises at least one handle for hand holding when it is detached from said primary unit;

wherein said handle is attached to and foldable onto one longitudinal side of said detachable elongate unit;

wherein said handle has a L shape and made from a round rod, and its lever is optionally implanted in a wooden end that has a larger diameter;

wherein said handle is perpendicular to and protruding from said longitudinal side when the detachable elongate unit is detached and in use;

wherein said detachable elongate unit further comprises at least one male plug placed on one end of said detachable elongate unit;

wherein said primary unit further comprises at least one female receptor to receive said male plug;

wherein, in addition to said plug, said detachable elongate unit further comprises a secure mechanism in the vicinity of said plug to further secure said detachable unit to said primary unit when said detachable unit is plugged in;

wherein said secure mechanism comprises two tabs perpendicular to each other, making an upside down T shape, protruding from one end of said primary unit, and two recesses fitting the shapes and sizes of said two tabs on one end of said detachable elongate unit to receive said two tabs snugly;

wherein said primary unit further comprises a flexible cord, whose one end is attached to said primary unit, and the other end is attached to said detachable elongate unit, to further secure said detachable elongate unit to said primary unit.

14. The method of claim 13 wherein said primary unit charges said detachable unit's battery when said detachable unit is attached to said primary unit.

15. The method of claim 13 wherein said light unit of said detachable unit draws electric power from said battery of said detachable unit when said detachable unit is attached to said primary unit.

16. The method of claim 13 wherein said light unit is a LED light.

17. The method of claim 13 wherein said primary unit draws electrical power from a housing unit which said cabinet is installed in.

18. The method of claim 13 wherein said primary unit is further comprised of a electrical charger is capable of charging said battery of said detachable unit when said detachable unit is attached to said primary unit.

19. The method of claim 13 wherein said detachable unit is further comprised of more than one light unit in at least two of the surfaces of said detachable unit.

20. The method of claim 13 wherein said lighting apparatus draws electrical power from a 120 v power outlet.

21. The method of claim 13 wherein said lighting apparatus draws electrical power from a 120 v power outlet.

22. The method of claim 13 wherein said lighting apparatus draws electrical power from a 120 v power outlet.

23. The method of claim 13 wherein said lighting apparatus draws electrical power from a 240 v power outlet.

24. The method of claim 13 wherein said lighting apparatus respond to a sound command.

* * * * *